US005788221A

United States Patent [19]

Mühlebach et al.

[11] Patent Number: 5,788,221

[45] Date of Patent: Aug. 4, 1998

[54] GRIPPING DEVICE FOR FREE LAYING OF FLOORING ELEMENTS

[75] Inventors: Moritz Mühlebach, Wallisellen; Stephan Szabo, Greifensee, both of Switzerland

[73] Assignee: Profloor Technology GmbH, Wallisellen, Switzerland

[21] Appl. No.: 857,304

[22] Filed: May 16, 1997

[30] Foreign Application Priority Data

May 20, 1996 [CH] Switzerland ..... 1263/96

[51] Int. Cl.[6] ..... A47G 27/04

[52] U.S. Cl. ..... 254/16

[58] Field of Search ..... 254/11–17, 113, 254/119, 129–131

[56] References Cited

U.S. PATENT DOCUMENTS 975,566 11/1910 Norton ..... 254/16
1,781,833 11/1930 Cummer ..... 254/17
3,779,515 12/1973 Larios et al. ..... 254/16
4,620,691 11/1986 Waters ..... 254/16

*Primary Examiner*—Robert C. Watson
*Attorney, Agent, or Firm*—Watson Cole Grindle Watson, P.L.L.C.

[57] ABSTRACT

A multi-part gripping device for pressing together flooring elements, such as laminates and finished parquet, in side-by-side relationship includes two rod parts that are axially and telescopically connected, one of said rod parts including a pressure jaw at an end having parallel shoulders that extend toward the other rod part, the shoulders being at a different spacing from the associated rod part for abutting a base portion of a flooring element over which the gripping device is positioned. A longitudinally adjustable lead screw is pivotally connected between the two rod parts for moving the two rod parts together, such that a connecting pressure is applied to a flooring element being interconnectably positioned adjacent one or more previously positioned flooring elements.

6 Claims, 2 Drawing Sheets

GRIPPING DEVICE FOR FREE LAYING OF FLOORING ELEMENTS

BACKGROUND OF THE INVENTION

1. Field of the Invention

The invention relates to a gripping device for flooring elements, such as laminates and finished parquet, which are to be connected in side-by-side relationship, the gripping device including a longitudinally adjustable, multi-part rod having pressure jaws at its opposite ends.

2. The Prior Art

In some situations flooring elements for covering a flooring surface are not adhesively bonded over their under surfaces to the underlying flooring surface, but are rather bonded to the side of the adjacent flooring element (free laying or floating technique). Such flooring elements, which may be in the form of elongated strips two meters or so in length, are pressed together and often positioned relative to one another via tongue and groove joints. If the adhesive gluing is not accomplished effectively in the first rows of flooring elements intended to cover an entire flooring surface, individual errors add up to a laying result that is intolerable in the end, e.g., a neat connection to the wall of the room opposite the start of laying cannot be achieved. This is why, when laying the first rows, a number of identical spaced apart gripping devices are used to press the rows of flooring elements together with just the right amount of pressure. Laminates and finished parquet differ in material thickness as well as in shape, and are also differently dimensioned with respect to the outer dimensions of the tongue-and-groove joint produced by different manufacturers and consist of a base material and a wear (exposed surface) layer consisting of another wood. It is important that this wear layer not be damaged when the gripping devices are used. The tongue at the flooring element edge which is to be inserted into the groove of an adjoining element, also should not be deformed by the pressure exerted by a gripping device, because the production of a neat plate joint would then no longer be possible.

With known gripping devices of this kind the gentle exertion of pressure against the edges of the flooring elements is not ensured because the pressure jaws, which usually consist of cast iron, do not press exclusively against the base material of the flooring elements. In addition, it is a disadvantage when, in the case of differently sized flooring elements, the thus required longitudinal adjustment of the gripping devices can only be carried out in stages because the pressure exerted is then too great or too little.

The object of the present invention is to create a gripping device that is suitable for the free laying of flooring elements and whose pressure jaws exert pressure exclusively against the base material of the flooring elements during laying, regardless of their size, shape or thickness, and wherein the longitudinally adjustable rods connecting the two pressure jaws always lies fully on the exposed surfaces of the flooring elements, so that when pressure is exerted on the lateral edges of, say, three rows of flooring elements, they cannot arch upward in the middle. Furthermore, the griping device should be able to very precisely, i.e., infinitely, adjust the pressure to be exerted during the laying of flooring elements of different shapes and thicknesses.

SUMMARY OF THE INVENTION

The object of the invention is achieved with a gripping device formed of first and second rod parts, the first rod part being axially (telescopically) movable in and out of the second rod part, one of the rod parts including a pressure plate at its end remote from the other rod part which includes parallel shoulders that extend toward the other rod part, one of the shoulders being spaced further from the adjacent rod part than the other. As such, to adjust for the thickness of the flooring elements being laid together, the rod parts can be disconnected from one another, and the rod part mounting the pressure plate rotated 180° and reconnected to the other rod part so that the relevant shoulder will contact the base portion of the flooring element and can also fit over its projecting tongue.

The invention will be better understood by reference to the accompanying drawings taken in conjunction with the following discussion.

DETAILED DESCRIPTION OF THE PREFERRED EMBODIMENT

Figure 1:
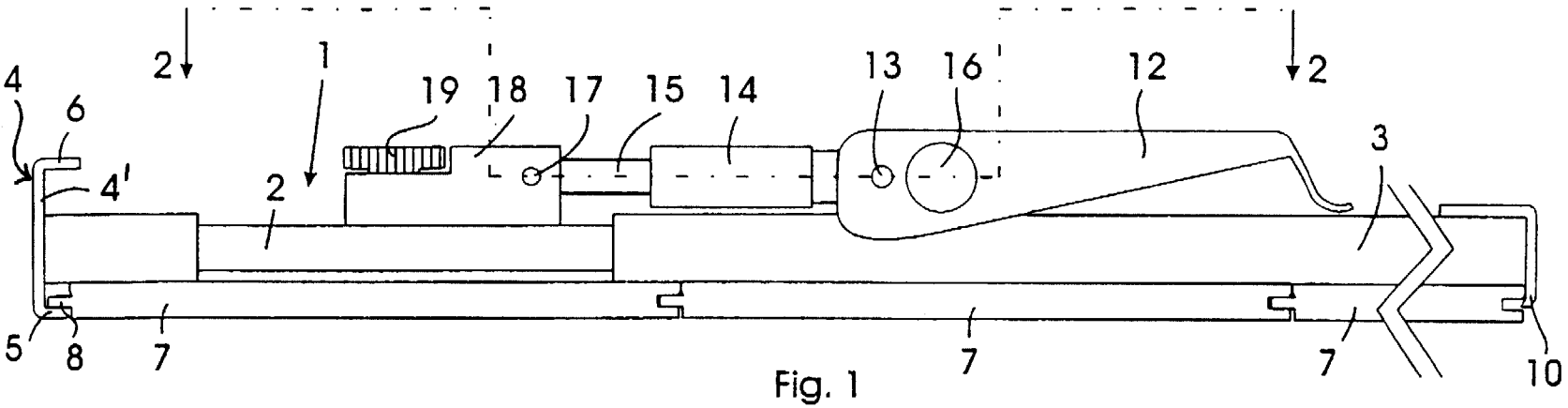
FIG. 1 is a side view of a preferred embodiment of a gripping device according to the present invention and positioned on three flooring elements having tongue and groove connection joints.

The gripping device according to the preferred embodiment of the present invention includes a multi-part, longitudinally adjustable rod 1 whose first rod part 2 is smaller in cross-section than the (longer) second rod part 3 and is axially (telescopically) movable therein. Welded to the end of the first rod part 2 is a pressure jaw 4 in the form of a flat plate 4' that has shoulders 5 and 6 protruding horizontally at two opposite edges in parallel with the first rod part 2. These shoulders consist of the bent edges of the plate 4' but could also be shoulder elements separately attached to the plate 4'.

Figure 4:
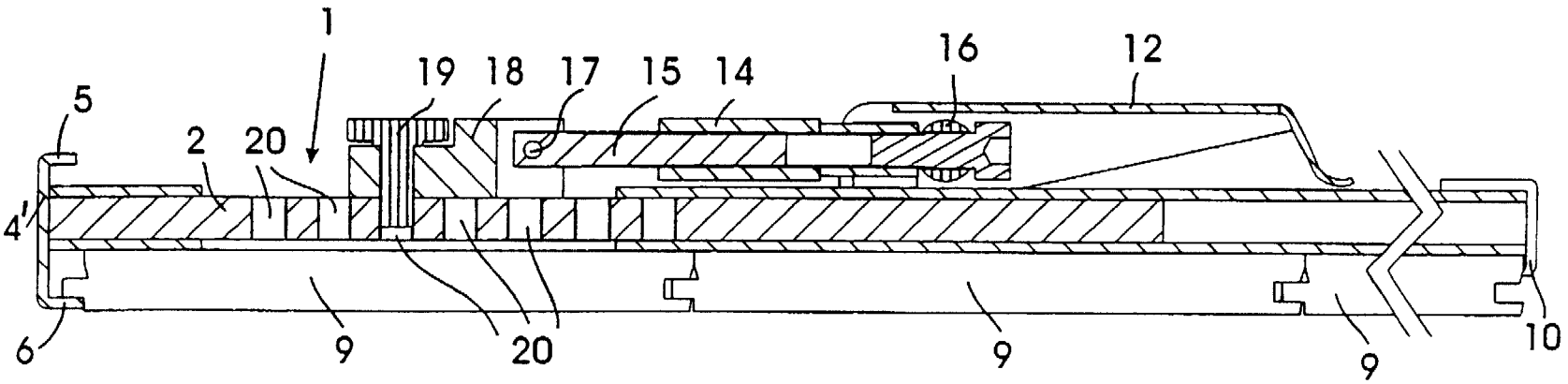
FIG. 4 is a longitudinal section of the gripping device along line 4—4 of FIG. 2.
Figure 2:
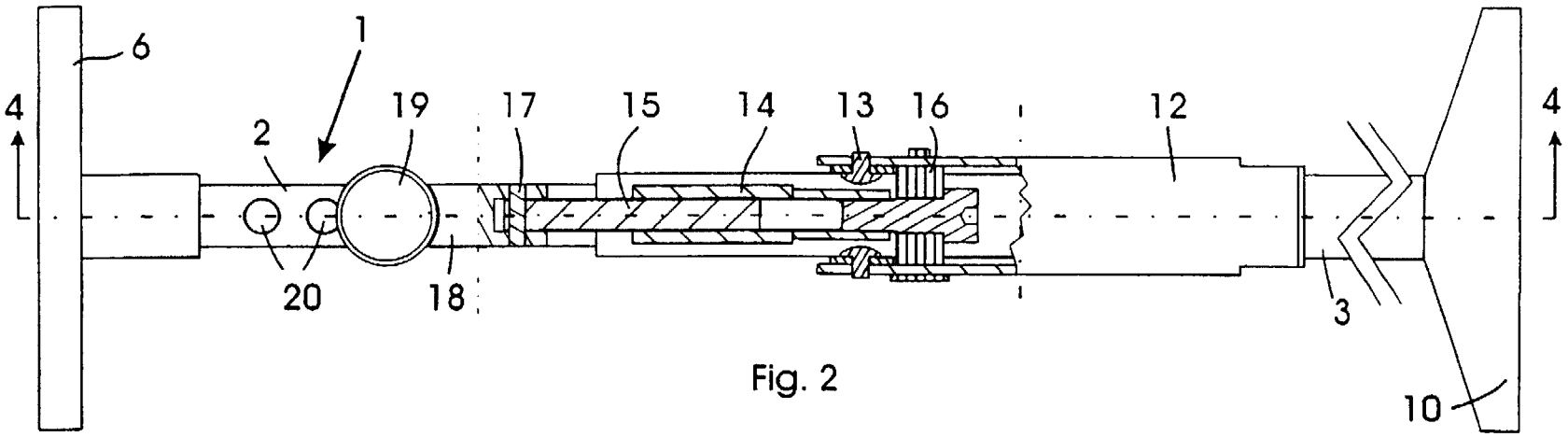
FIG. 2 is a view of the gripping device of FIG. 1, as seen along line 2—2 of FIG. 1.

The shoulders 5 and 6 are spaced different vertical distances from the rod part 2, so that the gripping device can be used for the laying of laminates as well as for finished parquet, which has a greater material thickness than laminates. In the case of the laminate 7, with the gripping device placed on top of the laminated flooring elements (plates), the shoulder 5 of the pressure jaw 4 lies below the tongue 8 and against the base material of the laminated flooring element, as can be seen from FIG. 1. The first rod part 2, which is rectangular in cross-section, after being separated from the second rod part 3 and then rotated 180°, can be used in the above-described manner for the thicker finished parquet 9, as shown in FIG. 4. Because of this design, the wear layer, visible after laying, on the base material and the tongue-and-groove joint are never damaged. With this design and application, the multi-part rod 1 also lies fully on the surfaces of the flooring elements, so that when pressure is exerted against three rows of flooring elements joined together, for example, none can arch upwardly as a result of the pressure. Situated at the opposite end of the gripping device is the pressure jaw 10 at a slight distance from the wall at which the laying work starts. The rod part 2 with the pressure jaw 4 can also be easily replaced with a pressure jaw of another design.

For the exertion of pressure on the flooring elements, a gripping force is exerted by the gripping device by means of a tension lever 12 that is connected to the second, longer rod part 3 at a hinge pin 13. To exert precisely the required pressure, an infinite longitudinal adjustment of the rod 1 is provided by a lead screw that consists of a threaded bush 14 and a threaded bolt 15 and is connected to the tension lever 12 by means of a swivel pin 16. By rotating the threaded bush 14, the length of the lead screw changes, whereby a longitudinal adjustment of the multi-part rod 1 can be achieved in the millimeter range for the adjustment of the required pressure force.

Figure 3:
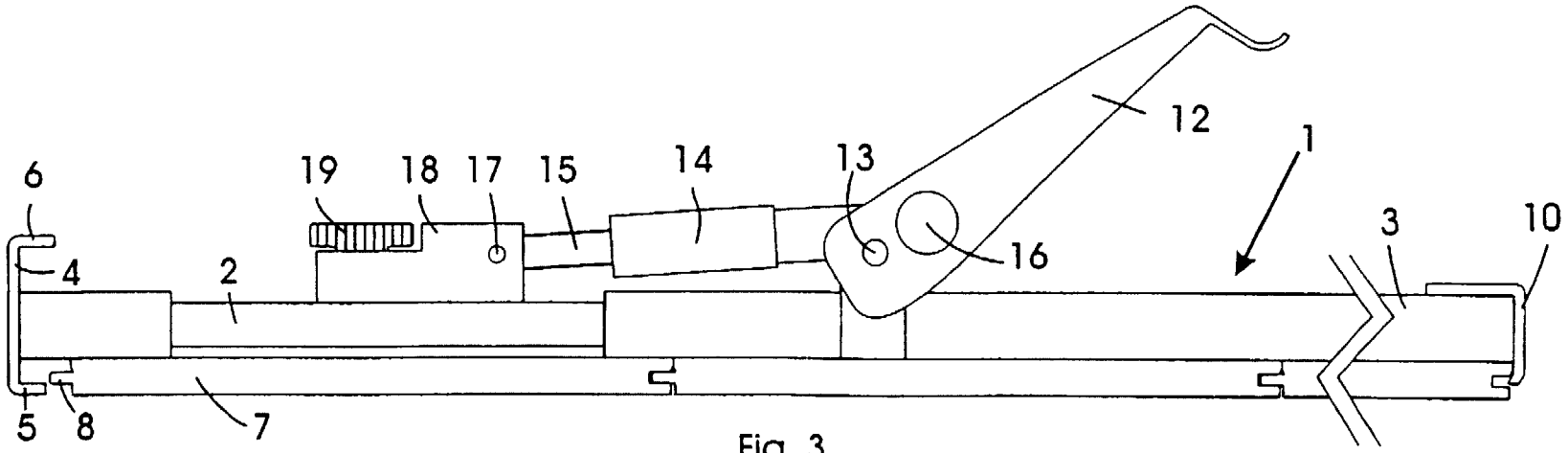
FIG. 3 is a side view of the gripping device similar to FIG. 1 but wherein the tension lever thereof is swung up.

The end of the threaded bolt 15 of the lead screw is connected via a swivel pin 17 with a coupling piece 18. This coupling piece 18 can be connected firmly with the first rod part 2, for example by means of a screw 19 that is screwed into one of a series of threaded bores 20 that are arranged at intervals on the top in the first rod part 2. In this way, a step-by-step modification of the length of the rod 1 is possible, when the gripping device is to be used for differently constructed flooring elements. The swivel pin 17 between the coupling piece 18 and the lead screw 14, 15 is necessary because the lead screw also swings upward during the swivelling motion of the tension lever 12, as can be seen from FIG. 3. When the above-dead-center position of the tension lever 12 is reached, the gripping position is reached when the tension lever lies fully on the rod 1.

We claim:

1. A gripping device for connecting flooring elements together in a side-by-side relationship to form a flooring surface, said gripping device including first and second interengaged rod parts which are axially movable relative to one another, each of said first and second rod parts including a pressure jaw at an end thereof remote from the other of said red parts, one of said pressure jaw including shoulders at opposite edges thereof which extend toward the other pressure plate and in parallel with said rod parts, one of said shoulders being located a greater distance from the adjacent rod part than the second shoulder, such that flooring elements of differing constructions and thicknesses can be accommodated by separation of said first and second rod parts, rotation of the rod part mounting the pressure plate with said shoulders by 180° and reconnection of said first and second rod parts.

2. A gripping device according to claim 1, including tension means which interconnect said first and second rod parts.

3. A gripping device according to claim 2, wherein said tension means comprises a coupling piece adjustably connected to said first rod part, a hinge pin connected to said second rod part, a lever rotatably connected to said hinge pin and a longitudinally adjustable tension rod means rotatably connected at one end to said coupling piece and at an opposite second end to said lever so that movement of said lever can cause said first and second rod parts to move together.

4. A gripping device according to claim 3, wherein said tension rod means comprises a threaded bolt and an interconnected threaded bush.

5. A gripping device according to claim 3, wherein said first rod part includes a series of spaced, threaded bores along a length thereof, said first coupling part includes a screw which is threadingly engageable within any of said bores to adjust the positioning of said first coupling part along the length of said first rod part.

6. A gripping device according to claim 1, wherein said one pressure jaw comprises an elongated metal plate whose opposite elongated edges are bent 90° to provide said shoulders.

* * * * *